US005799344A

United States Patent [19]

Najar

[11] Patent Number: 5,799,344

[45] Date of Patent: Sep. 1, 1998

[54] NECK SUPPORT CUSHION FOR UTILIZATION IN CONJUNCTION WITH HAIR TREATMENT

[76] Inventor: Michael Najar, 2552 Summit Rd., Manasquan, N.J. 08736

[21] Appl. No.: 603,169

[22] Filed: Feb. 20, 1996

[51] Int. Cl.[6] ..... A45D 44/10

[52] U.S. Cl. ..... 4/523; 5/636; 297/397

[58] Field of Search ..... 4/515–523; 5/575.1, 5/636–643; 297/391, 393, 397–402

[56] References Cited

U.S. PATENT DOCUMENTS

| | | | |
|---|---|---|---|
| 727,452 | 5/1903 | Romans . | |
| 1,244,715 | 10/1917 | Dozier . | |
| 2,161,590 | 6/1939 | Rickard | 4/523 |
| 2,803,834 | 8/1957 | McClung . | |
| 2,988,753 | 6/1961 | Corvelli | 4/523 |
| 3,103,219 | 9/1963 | Chadner | 5/636 X |
| 3,156,500 | 11/1964 | Kerr | 297/397 X |
| 3,578,383 | 5/1971 | Earl | 5/643 X |
| 4,167,048 | 9/1979 | Williams . | |
| 4,327,452 | 5/1982 | Swatzell . | |
| 4,385,408 | 5/1983 | Rhodes . | |
| 4,597,386 | 7/1986 | Goldstein | 5/640 X |
| 4,731,891 | 3/1988 | Scheurer et al. | 5/636 |
| 4,805,603 | 2/1989 | Cumberland | 5/640 X |
| 5,033,137 | 7/1991 | Pedrow | 5/636 |
| 5,129,705 | 7/1992 | Wray | 297/397 |
| 5,503,456 | 4/1996 | Rossini | 297/397 |

FOREIGN PATENT DOCUMENTS

| | | | |
|---|---|---|---|
| 1941603 | 3/1978 | Germany | 5/638 |

*Primary Examiner*—Charles E. Phillips
*Attorney, Agent, or Firm*—Clifford G. Frayne

[57] ABSTRACT

An anatomically-correct neck and head support removably securable to a barber, beautician or salon chair for use when the individual is placed in a reclined position, the support being a lightweight foam or resilient material covered with a water-resistant, chemical-resistant, washable, sanitizable covering, the upper surface having a double arcuate surface complimentary with the normal cervical lordotic curve of an individual's spine and neck, the support providing planar and lateral support to the neck area of the individual.

3 Claims, 4 Drawing Sheets

NECK SUPPORT CUSHION FOR UTILIZATION IN CONJUNCTION WITH HAIR TREATMENT

BACKGROUND OF THE INVENTION

1. Field of the Invention

The present invention relates to the field of neck and head supports and, in particular, a neck support cushion cooperable with a barber or beautician's chair to support the neck and head when positioned in a reclining mode proximate to a sink for shampooing, rinsing, permanents, dyeing and the like.

2. Description of the Prior Art

Both men and women utilize the services of barbers and beauticians in order to have their hair styled, shampooed and rinsed, dyed, or to have a permanent performed. A procedural element of all the aforementioned is the reclining of the individual, rearwardly, so that the hair can be positioned over an adjacent sink for rinsing with water.

This positioning of the individual is often awkward and uncomfortable in that the person's head is oftentimes positioned lower than the chest cavity, and that portion of the person's head having active hair follicles, must extend over the sink. Support therefore must be placed in the non-hair growing region of the neck.

Various attempts have been made to mollify the awkwardness and uncomfortableness of this positioning. These attempts include U.S. Pat. No. 1,244,715 to Dozier et al. which attempts to move the support upwardly from the sink; U.S. Pat. No. 727,452 to Romans, which suggests an alternative form of headrest, U.S. Pat. No. 2,803,834 to McClung for another form of extension apparatus; U.S. Pat. No. 4,167,048 to Williams for a support and runoff collection apparatus; U.S. Pat. No. 4,327,452 to Swatzell which illustrates a neck support pad which secures directly to the lip of the sink; U.S. Pat. No. 4,385,408 to Rhodes which again discloses another cushioning pad which is secured to the sink.

All of the aforementioned attempt to provide an alternative form of support, however, all are found lacking in that none provide an anatomically correct support designed to conform to the normal cervical lordotic curve which provides for support to the upper mid back region extending upwardly to support the base of the head and neck. This contour allows the back, shoulder and neck muscles to relax and maintain the neutral position of the neck curve preventing extension which is a common cause of neck, shoulder and head pain.

It is of particular relevance in light of recent case studies, some of which are reported in the Apr. 28, 1993 issue of the Journal of the American Medical Society, Volume 269, number 16 (copy of which is attached with PTOL Form 1449). These studies appear to indicate that certain individuals are at risk when placed in such a position, for potential stroke or stroke-related injuries. This appears to be attributable to the reclined position, extension of the neck, and possible movement of the head in a back and forth position during the treatment.

Therefore, a need exists for a cervical correct support which provides planar and lateral support at the appropriate location when an individual is so positioned. Applicant's invention addresses this issue with an apparatus which is cervically correct and which can be adapted for use to existing barber and beautician chairs or incorporated in the design of barber and beautician chairs.

SUMMARY OF THE INVENTION

An anatomically correct neck and head support removably securable to a barber, beautician or salon chair for use when the individual is placed in a reclined position, the apparatus being comprised of a lightweight foam or resilient material covered with a water-resistant, chemical-resistant, washable, sanitizable covering, the upper surface having an arcuate surface complimentary with the normal cervical lordotic curve of an individual's spine, the apparatus providing planar and lateral, support for the neck area of the individual.

OBJECTS OF THE INVENTION

An object of the present invention is to provide for a novel neck and head support removably securable to a barber or beautician chair, the support having an upper surface conforming to the normal cervical lordotic curve allowing support of the mid back region extending upwardly to support the base of the head and neck.

A further object of the present invention is to provide for a novel support which will support the neck and head in a relaxed, comfortable position when reclined in a barber or beautician's chair thereby reducing the risk of cervical strain, sprain, neck injuries and pinched nerves, headaches and muscle spasms.

A still further object of the present invention is to provide for a novel support which reduces the risk of diminished vertebral or carotid blood flow to the brain.

A still further object of the present invention is to provide for a novel support which is both water resistant and chemical resistant and capable of being sanitized.

A still further object of the present invention is to provide for a novel support which limits the ability of a barber or beautician to hyper-extend or rotate the individual's head and neck.

BRIEF DESCRIPTION OF THE DRAWINGS

These and other objects of the present invention will be more apparent particularly when taken in view of the accompanying illustrations wherein.

DETAILED DESCRIPTION OF THE DRAWINGS

Figure 1:
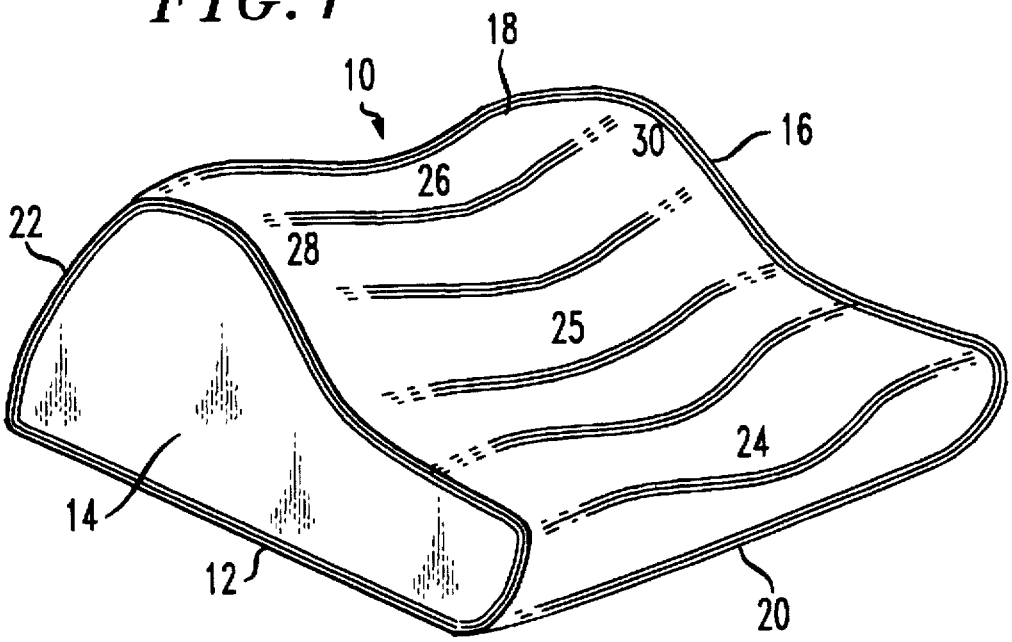
FIG. 1 is a perspective view of a preferred embodiment of the present invention.

FIG. 1 is a perspective view of neck support 10. Neck support 10 is essentially a cushion having a flexible resilient padding which is preshaped and overlaid with a protective covering which is water resistant and chemical resistant. The preformed padding and the protective overlaid covering define a neck support cushion 10 having a base 12, side panels 14 and 16 and an upper surface 18. Base 12 is generally planar while side panel 14 and 16 and upper surface 18 cooperate to form an arcuate surface having separately-defined sectors.

From the front 20 of neck support ten to the rear 22 of neck support 10, upper surface 18 commences with a gentle upward slope in sector 24, the slope increasing in sector 25 and reaching an apex in sector 26 at which point the arcuate slope descends severely, thereby defining the rear portion 22 of neck support 10.

The arcuate surface of upper surface 18 through sectors 24, 25 and 26 correspond to the normal cervical lordotic curve of an individual's spine, which commences in the upper back region of an individual medial the shoulder blades, and extends through the neck region to the base of the skull.

In addition to upper surface 18 having this gradually upwardly sloping arcuate surface to sector 26 followed by a rapidly descending arcuate surface, upper surface 18 also has an arcuate shape extending from side panel 14 to side panel 16, neck support 10, thus exhibiting a double curved upper surface 18.

This second curvature of upper surface 18 is bilateral with respect to the longitudinal axis of neck support 10 running from front end 20 to rear end 22. This second curvature is designed to support the neck and cervical area so as to prevent any radical rotation of the neck and the head. This second curvature which runs transverse on neck cushion 10 has its respective apexes 28 and 30 proximate to side panels 14 and 16 respectively. The curvature or slope descends from these apexes downwardly and medially until it melds into sectors 24, 25, and 26 of the longitudinal curvature of neck support 10. The transverse curvature depends medially towards the longitudinal axis, the greatest distance proximate to the apex 28 and 29 and decreases its downward medial slope towards the longitudinal axis as it approaches front end 20 and rear end 22. The transverse curvature therefore defines a valley or depression which commences with a low elevation in sector 24 having increasing elevation through sector 25 to sector 26, thereafter, the arcuate elevation decreasing rapidly to end 22. The transverse curvature defines two (2) mounds on opposing sides of the valley or depression defined by apexes 28 and 30 which provide side to side resistance and thus prevent any radical or sudden rotation of the neck or head, since the depression or valley defines the location wherein there would be positioned the nape of the individual's neck.

Figure 2:
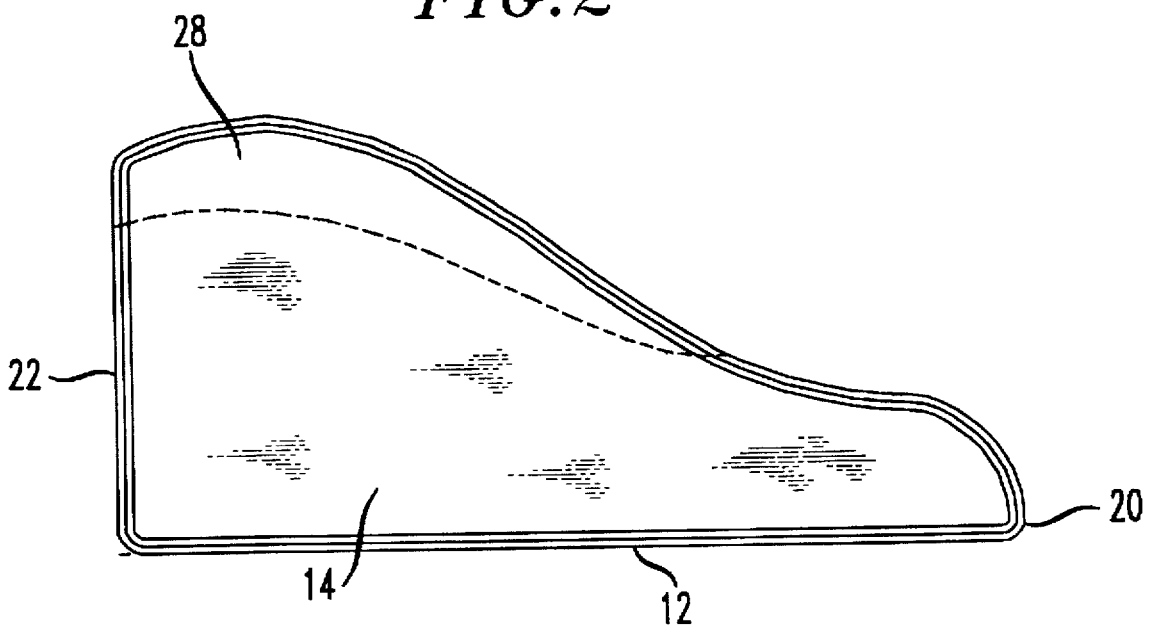
FIG. 2 is a side view of the preferred embodiment of the present invention.
Figure 3:
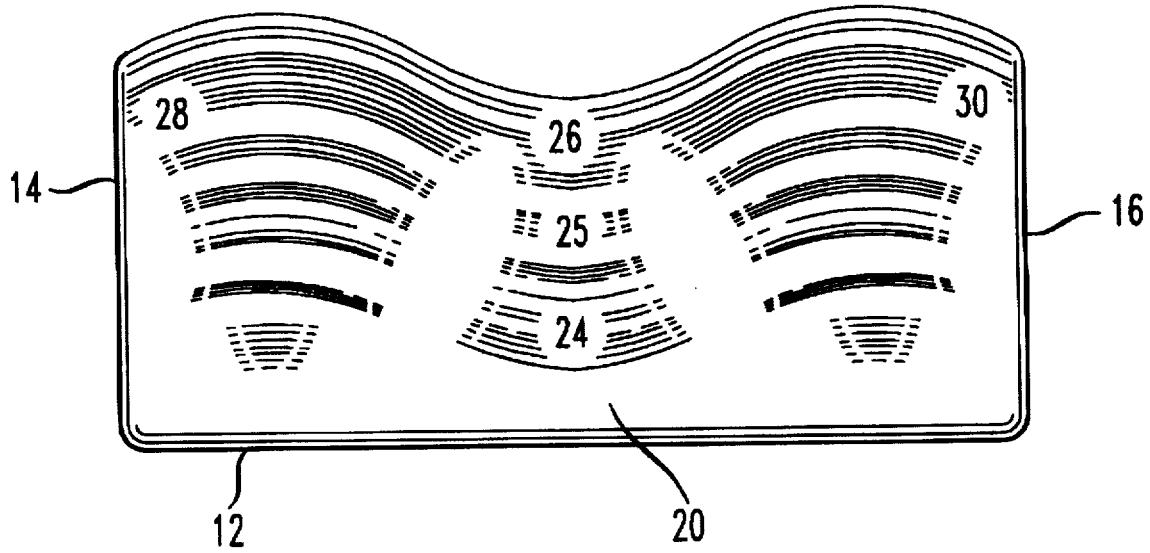
FIG. 3 is a front view of the preferred embodiment of the present invention;.

FIGS. 2 and 3 represent a side view and a front view of the preferred embodiment illustrated in perspective view FIG. 1. FIG. 2, in particular, illustrates the cervical lordotic curve which the neck support cushion seeks to achieve in order to conform or match up with the anatomical cervical lordotic curve of the individual.

Figure 4:
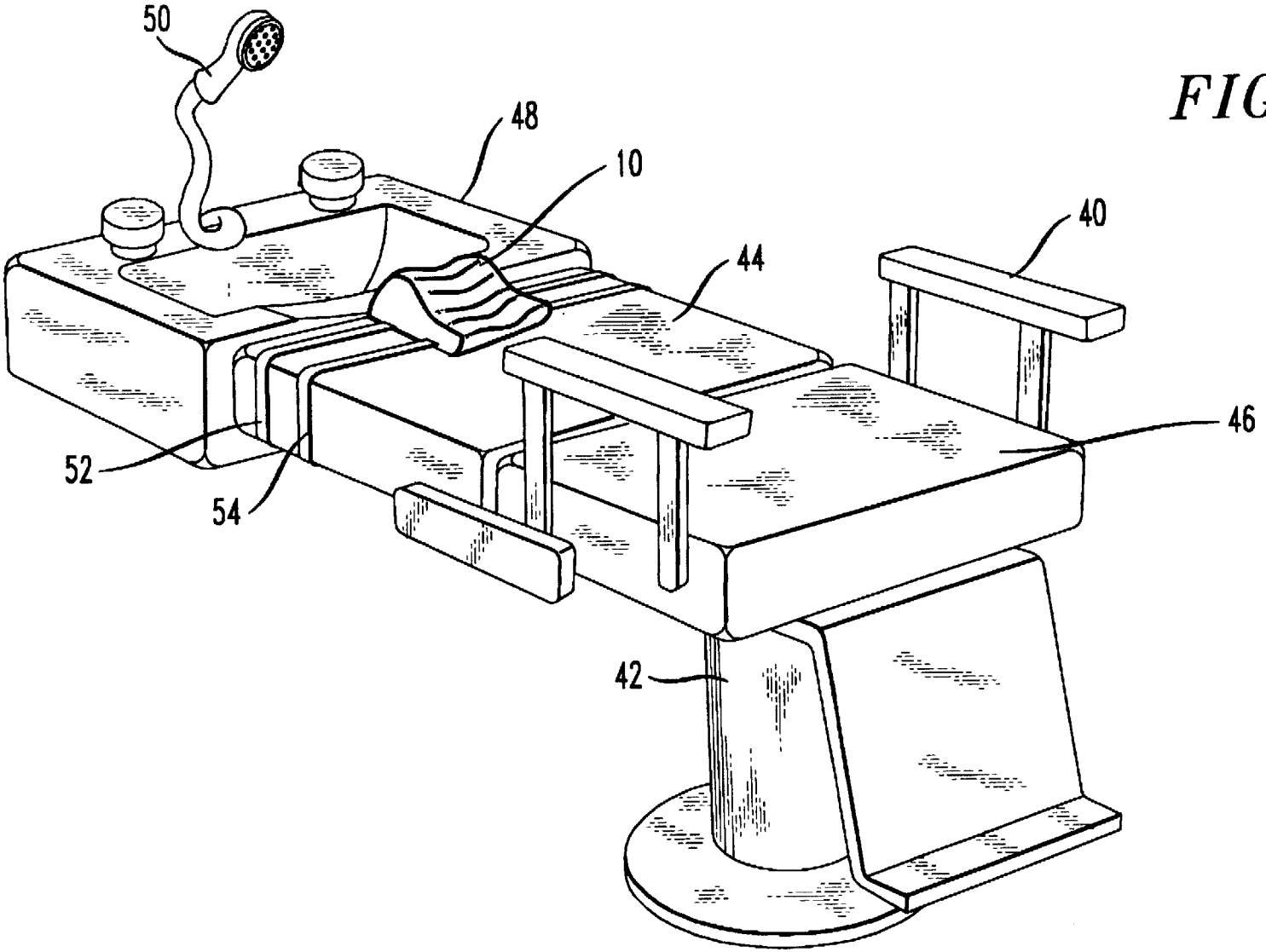
FIG. 4 is a perspective view of the preferred embodiment of the present invention incorporated with a barber's chair or beautician's chair.

FIG. 4 illustrates the positioning of the neck support 10 in the actual surrounding of its intended use. Typically, a barber's chair or beautician's chair 40 is securely mounted to the floor by means of a pedestal 42. The chair 40 is designed to swivel 360° about the axis of pedestal 42. Additionally, the rear or back support portion 44 of chair 40 can be lowered to a desired angle with relationship to the seat portion 46. Back support portion 44 is typically lowered in order to place the individual's head in proximity to a washbasin 48, washbasin 48 having the necessary hose and shower attachments 50 to rinse the hair of the individual. As illustrated in FIG. 4, neck support cushion 10 is secured to chair 40 proximate to the upper end 52 of back support portion 44 of chair 40.

The manner of securing neck support cushion 10 to upper portion 52 of chair 40 is one of choice and convenience. Neck support cushion 10 could have straps 54 secured to its underside surface 12, and straps 54 could encircle back support portion 44 of chair 40 and be secured on the underside. An alternative would be the use of cooperative hook and loop fasteners on the undersurface 12 of neck support cushion 10 and the ends of straps 54 to position neck support cushion in its proper location. The object would be to permit the barber or beautician to be able to affix neck support cushion 10 in its proper position with ease and efficiency, at the proper time during the procedure, before lowering back support portion 44 of chair 40 into a substantially horizontal position for the rinsing of the individual's hair.

Figure 5:
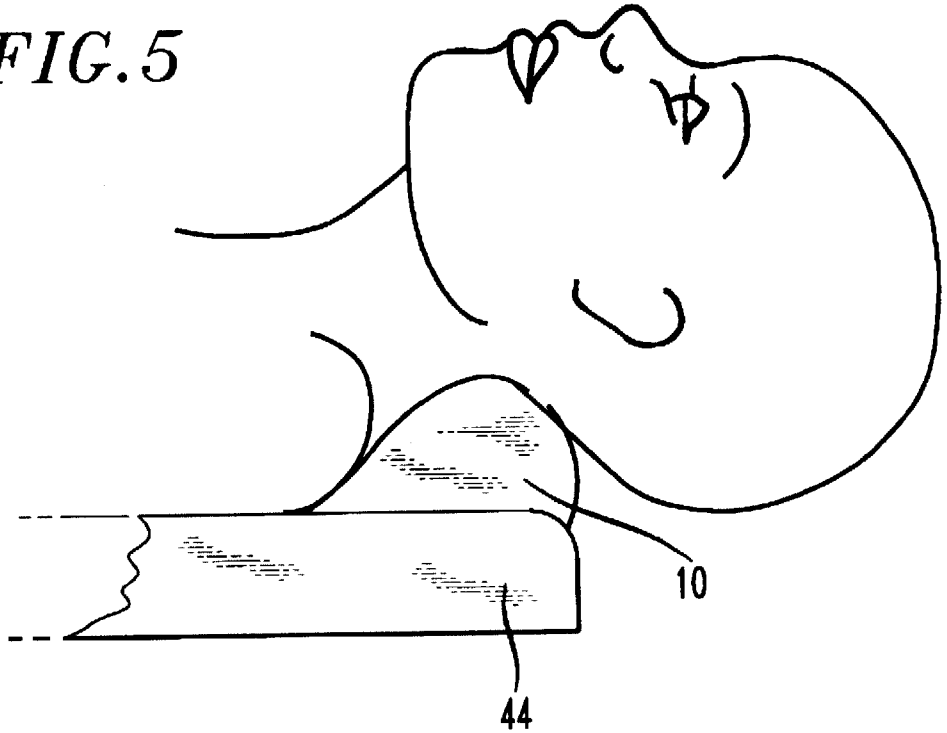
FIG. 5 is a side view illustrating the cooperativeness of the preferred embodiment of the present invention with the cervical area of an individual.

FIG. 5 is a side view of neck support cushion 10 illustrating the cooperativeness of neck support cushion 10 with the neck and upper spinal area of the individual. FIG. 5 illustrates the manner in which neck support cushion 10 longitudinally supports the upper spine and neck area and also illustrates the manner in which neck support cushion 10 transversely partially encircles the neck area to prevent not only extension of the neck, but the possible movement of the head and hence the neck in a back and forth motion during treatment.

Figure 6:
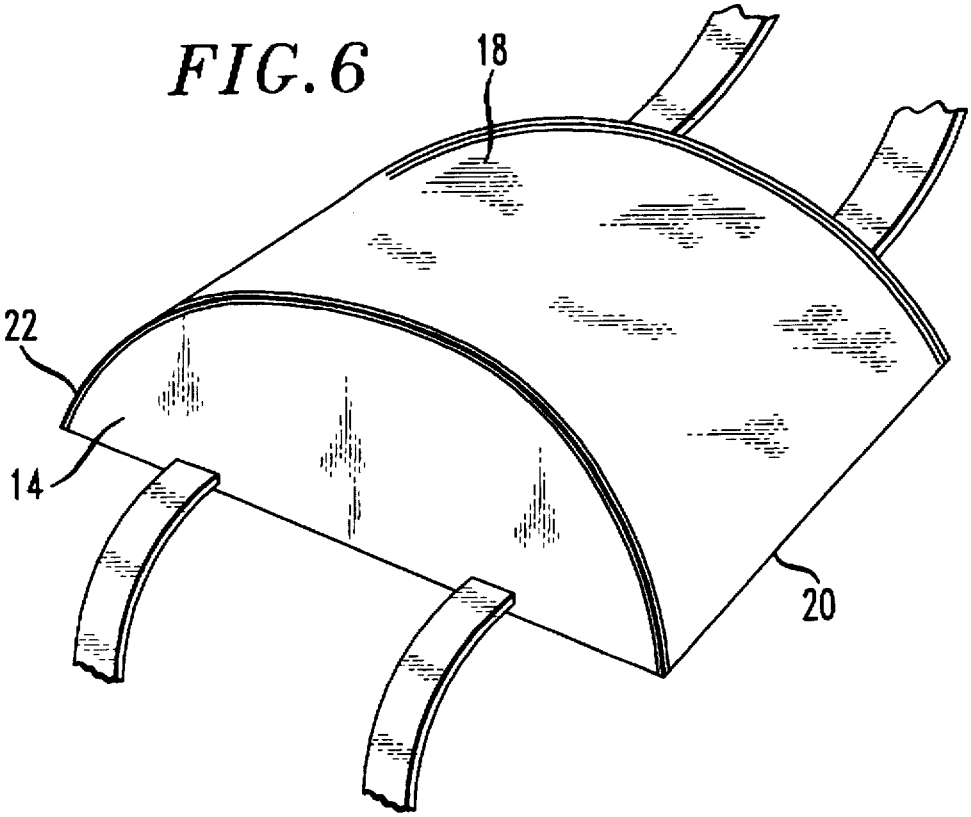
FIG. 6 is a perspective view of a second embodiment of the present invention.

In the preferred embodiment, the interior portion of neck support cushion 10 comprised of a lightweight foam or resilient material would be preshaped in accordance with the description accompanying FIG. 1. The lightweight foam or resilient material would be of such a character that it would cushion the cervical lordotic curve of the individual's spine without being substantially deformed. In a second embodiment of the invention, the neck support cushion 10 could be comprised of a lightweight foam or resilient material having greater deformation capability than that of the resilient material envisioned for the preferred embodiment. In this second embodiment of the neck support cushion 10, the upper surface 18 would have the same arcuate surface running from front edge 20 to rear edge 22, but would not have the preformed transverse arcuate surface running from side 14 to side 16. In this second embodiment, through the use of a more deformable resilient material comprising the interior, the weight of the individual's neck and head would serve to create the transverse arcuate surface when the head was positioned on this second embodiment as illustrated in FIG. 6. This second embodiment could also be secured to the beautician or barber's chair 40 by a suitable securing means of design or choice which would allow the barber or the beautician to facilitate its positioning prior to the rinsing of the hair.

Both of the embodiments discussed thus far are adapted primarily for use on existing beautician, barber and salon chairs. They are designed for ease of positioning for use and ease of removal and the outer surface would be comprised of a water-resistant, chemical-resistant, washable, sanitizable covering material which would allow the barber or the beautician to wash, clean and/or sanitize it between uses.

Figure 7:
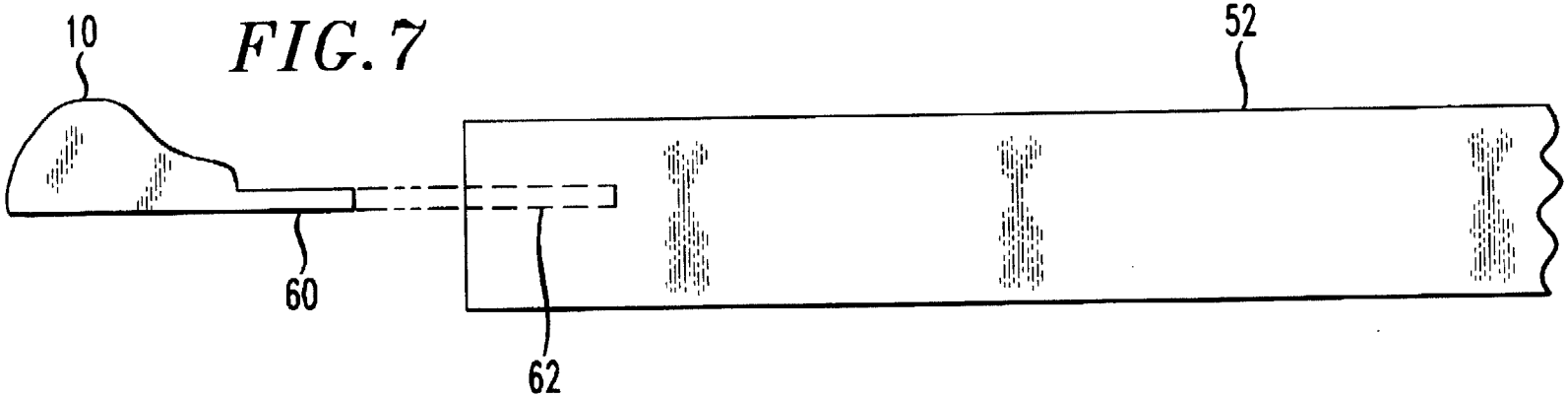
FIG. 7 is a side view of a third embodiment of the present invention.

The same concept of neck support cushion 10 could also be adapted to newly-manufactured barber's chairs, beautician's chairs and salon chairs. Undersurface 12 of neck support cushion 10 could have a rigid securing member 60 positioned on the longitudinal axis which would allow a snap-fit into a receptacle 62 at the top portion 52 of barber's chair 40. This would allow it to be snap-fit into position prior to the lowering of neck support portion 44 of chair 40 for the rinsing of hair, and it could be removed from its snap-fit receptacle when not in use. FIG. 7 illustrates a side view of this embodiment.

While the present invention has been described in connection with the exemplary embodiments thereof, it will be understood that many modifications will be apparent to those of ordinary skill in the art and that this application is intended to cover any adaptations or variations thereof. Therefore, it is manifestly intended that this invention by only limited by the claims and the equivalents thereof.

What is claimed is:

1. Neck support for individuals for use during hair treatment and shampooing comprising:

a salon chair for the support of said individual having a back, positionable from an upright position to a reclining position, said reclining position cooperable with a sink;

a resilient cushion removably positioned on said back of said salon chair in said upright and said reclined position, said resilient cushion having a planar base in communication with said back of said salon chair proximate the top of said back of said salon chair, said resilient cushion having opposing sidewalls, a front edge and a rear edge, an upper surface extending from said front edge to said rear edge, said upper surface preformed to the cervical lordotic curve of said individual's upper spine and neck, said preformed upper surface being double curved, having a first arcuate surface preformed to said cervical lordotic curve of said spine, said first arcuate surface extending from said front edge of said resilient cushion to said rear edge, said upper surface having a second arcuate surface extending transverse between said opposing sidewalls, said second arcuate surface being complimentary to the rear circumference of the individual's neck;

a protective covering means;

means for removably securing said cushion to said salon chair.

2. The neck support cushion in accordance with claim 1 wherein said securing means comprises a plurality of strap means secured to said neck support cushion and encircling said back of said salon chair, positioning said neck support cushion proximate to the top of the back of said salon chair.

3. The neck support cushion in accordance with claim 1 wherein said securing means includes a snap-fit tongue member secured to said neck support cushion and removably securable in a recess in said top of said salon chair, positioning said neck support cushion in an extended position beyond the top of said salon chair when in a reclined position.

* * * * *